US007746314B2

(12) United States Patent
Wei et al.

(10) Patent No.: US 7,746,314 B2
(45) Date of Patent: Jun. 29, 2010

(54) LIQUID CRYSTAL DISPLAY AND SHIFT REGISTER UNIT THEREOF

(75) Inventors: Chun-Ching Wei, Taipei (TW); Shih Hsun Lo, Sinfong Township, Hsinchu County (TW); Yang-En Wu, Taipei (TW)

(73) Assignee: AU Optronics Corp., Hsinchu (TW)

( * ) Notice: Subject to any disclaimer, the term of this patent is extended or adjusted under 35 U.S.C. 154(b) by 838 days.

(21) Appl. No.: 11/525,869

(22) Filed: Sep. 25, 2006

(65) Prior Publication Data

US 2007/0245193 A1 Oct. 18, 2007

(30) Foreign Application Priority Data

Mar. 22, 2006 (TW) ..... 95109940

(51) Int. Cl.
*G09G 3/36* (2006.01)

(52) U.S. Cl. ..... 345/100; 377/64

(58) Field of Classification Search ..... 345/92–100; 377/64–81

See application file for complete search history.

(56) References Cited

U.S. PATENT DOCUMENTS 5,410,583 A * 4/1995 Weisbrod et al. ..... 377/75
6,337,651 B1 * 1/2002 Chiang ..... 341/161
6,845,140 B2 1/2005 Moon et al.
6,876,353 B2 * 4/2005 Morosawa et al. ..... 345/100
7,317,780 B2 * 1/2008 Lin et al. ..... 377/67
7,342,568 B2 * 3/2008 Wei et al. ..... 345/100
7,400,698 B2 * 7/2008 Chang et al. ..... 377/64
2004/0196232 A1 * 10/2004 Kim et al. ..... 345/89
2006/0139293 A1 * 6/2006 Cho ..... 345/100
2006/0267912 A1 * 11/2006 Lee et al. ..... 345/100

FOREIGN PATENT DOCUMENTS

CN 1652193 A 8/2005
CN 1731501 A 2/2006

* cited by examiner

*Primary Examiner*—Alexander Eisen
*Assistant Examiner*—Patrick Marinelli
(74) *Attorney, Agent, or Firm*—Rabin & Berdo, P.C.

(57) ABSTRACT

A liquid crystal display and a shift register unit thereof are provided. The shift register unit includes a first switch, a second switch, and a level shift circuit. The first switch has a first input terminal, a first control terminal, and a first output terminal. The second switch has a second input terminal, a second control terminal, and a second output terminal. The second control terminal is coupled to the first output terminal and the level shift circuit. When the first switch is enabled, the first input terminal receives an input signal converting the voltage of the second control terminal into a first voltage for turning on the second switch. The second output terminal outputs a first clock signal to a scan signal line. When the level shift circuit is enabled, the voltage of the second control terminal is converted into a second voltage for turning off the second switch.

16 Claims, 10 Drawing Sheets

LIQUID CRYSTAL DISPLAY AND SHIFT REGISTER UNIT THEREOF

This application claims the benefit of Taiwan Patent application Serial No. 95109940, filed Mar. 22, 2006, the subject matter of which is incorporated herein by reference.

BACKGROUND OF THE INVENTION

1. Field of the Invention

The invention relates in general to a liquid crystal display and a shift register unit thereof, and more particularly to a liquid crystal display and a shift register unit thereof capable of improving operating frequency.

2. Description of the Related Art

In order to reduce the manufacturing cost of a-Si liquid crystal display, the chip on glass (COG) technology is provided and used in the semi-conductor industry. According to the COG technology, the driving circuits such as the scan driver or the data driver are disposed on an a-Si display panel so as to simplify the manufacturing process of a-Si liquid crystal display and further bring the manufacturing cost down.

Referring to FIG. 1, a schematic diagram of a conventional a-Si liquid crystal display is shown. The conventional a-Si liquid crystal display 10 includes a scan driver 110, a scan signal line 120, a data driver 130, a data line 140, and a display panel 150. The display panel 150 includes a pixel 152. The scan driver 110 and the data driver 130 are disposed on the display panel 150 with the COG technology.

The scan driver 110 is coupled to a power voltage Vss. The scan driver 110 sequentially outputs a scan driving signal $S_{scan}(n)$ according to a starting signal ST, a clock signal CK, and a clock signal XCK, where n is a positive integer. The scan driving signal $S_{scan}(n)$ sequentially activates the pixel 152 in each row via the scan signal line 120. The data driver 130 inputs an image data to the pixel 152 via the data line 140 to generate a corresponding display frame.

Referring to FIG. 2, a schematic diagram of a scan driver is shown. Furthermore, the scan driver 110 includes a number of shift register units 112. Each shift register unit 112 is coupled to the power voltage Vss. The first level shift register unit 112 outputs a scan driving signal $S_{scan}(1)$ according to a starting signal ST, a clock signal CK and a clock signal XCK. The second level shift register unit 112 outputs a scan driving signal $S_{scan}(2)$ according to the scan driving signal $S_{scan}(1)$, the clock signal CK and the clock signal XCK. Likewise, each level shift register unit 112 sequentially outputs a corresponding scan driving signal $S_{scan}(n)$.

Referring to FIG. 3, a schematic diagram of a clock signal is shown. The duty cycle of the clock signal CK and the duty cycle of the clock signal XCK are 50%. The clock signal CK and the clock signal XCK can not at enabled level or non-enabled level at the same time.

The shift register unit 112 is made from a-Si thin film transistors. Since the a-Si thin film transistors have low mobilityso that the operating frequency of the scan driver 110 is restricted, thus a correct scan driving signal can not be outputted.

Referring to FIG. 4, a timing diagram of a conventional the scan driving signal is shown. Since the a-Si thin film transistor has low mobility, when the scan driver 110 is applied in a high-resolution liquid crystal display, the scan driver 110 is unable to output a correct scan driving signal.

For example, when the starting time of the scan signal line 120 is 5 us, the scan driver 110 still generates a scan driving signal beyond the starting time, causing error to the liquid crystal display and affecting the quality of display frame.

Besides, the shift register unit 112 occupies a large area and is difficult to be disposed, thus making the design of the circuit layout more difficult.

SUMMARY OF THE INVENTION

It is therefore an object of the invention to provide a liquid crystal display and a shift register unit thereof capable of improving operating frequency. The invention uses two groups of scan drivers for respectively driving odd-numbered scan signal lines and even-numbered scan signal lines. The two groups of scan drivers respectively receive two independent group of starting signals and clock signals for improving the operating frequency of the scan drivers. With the two groups of scan drivers being disposed on the two sides of the display panel, the circuit layout design is more flexible.

The invention achieves the above-identified object by providing a shift register unit. The shift register unit receives an input signal and generates a scan driving signal according to the input signal. The shift register unit includes a first switch, a second switch, and a level shift circuit. The first switch has a first input terminal, a first control terminal, and a first output terminal. The second switch has a second input terminal, a second control terminal, and a second output terminal. The first output terminal and the level shift circuit are coupled to the second control terminal.

When the shift register unit is during a first time period, the first switch is enabled, and the first input terminal receives an input signal converting the voltage of the second control terminal into a first voltage for turning on the second switch. When the shift register unit is during a second time period, the second control terminal is substantially maintained at the first voltage. And the second input terminal receives a first clock signal such that the second output terminal outputs the first clock signal to a scan signal line. When the shift register unit is during a third time period, the level shift circuit is enabled for converting the voltage of the second control terminal into a second voltage for turning off the second switch.

The invention further achieves the above-identified object by providing a liquid crystal display. The liquid crystal display includes a pixel, a data line, a number of odd-numbered scan signal lines, even-numbered scan signal lines, a first scan driver, and a second scan driver. The data line is coupled to the pixel for transmitting an image data to the pixel. The odd-numbered scan signal lines and the even-numbered scan signal lines are coupled to the pixel for transmitting a scan driving signal to the pixel. The first scan driver is for driving the odd-numbered scan signal lines, while the second scan driver is for driving the even-numbered scan signal lines.

The first scan driver and the second scan driver respectively include a shift register unit. Each shift register unit includes a first switch, a second switch and a level shift circuit. The first switch has a first input terminal, a first control terminal, and a first output terminal. The second switch has a second input terminal, a second control terminal, and a second output terminal. The first output terminal and the level shift circuit are coupled to the second control terminal.

When the liquid crystal display is during a first time period, the first switch is enabled and the first input terminal receives an input signal converting the voltage of the second control terminal into a first voltage for turning on the second switch. When the liquid crystal display is during a second time period, the second control terminal is substantially maintained at the first voltage and the second input terminal receives a first clock signal, such that the second output terminal outputs a first clock signal to one of the odd-numbered scan signal lines or one of the even-numbered scan signal line to form a scan driving signal. When the liquid crystal display is during a third time period, the level shift circuit is enabled for converting the voltage of the second control terminal into a second voltage for turning off the second switch.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
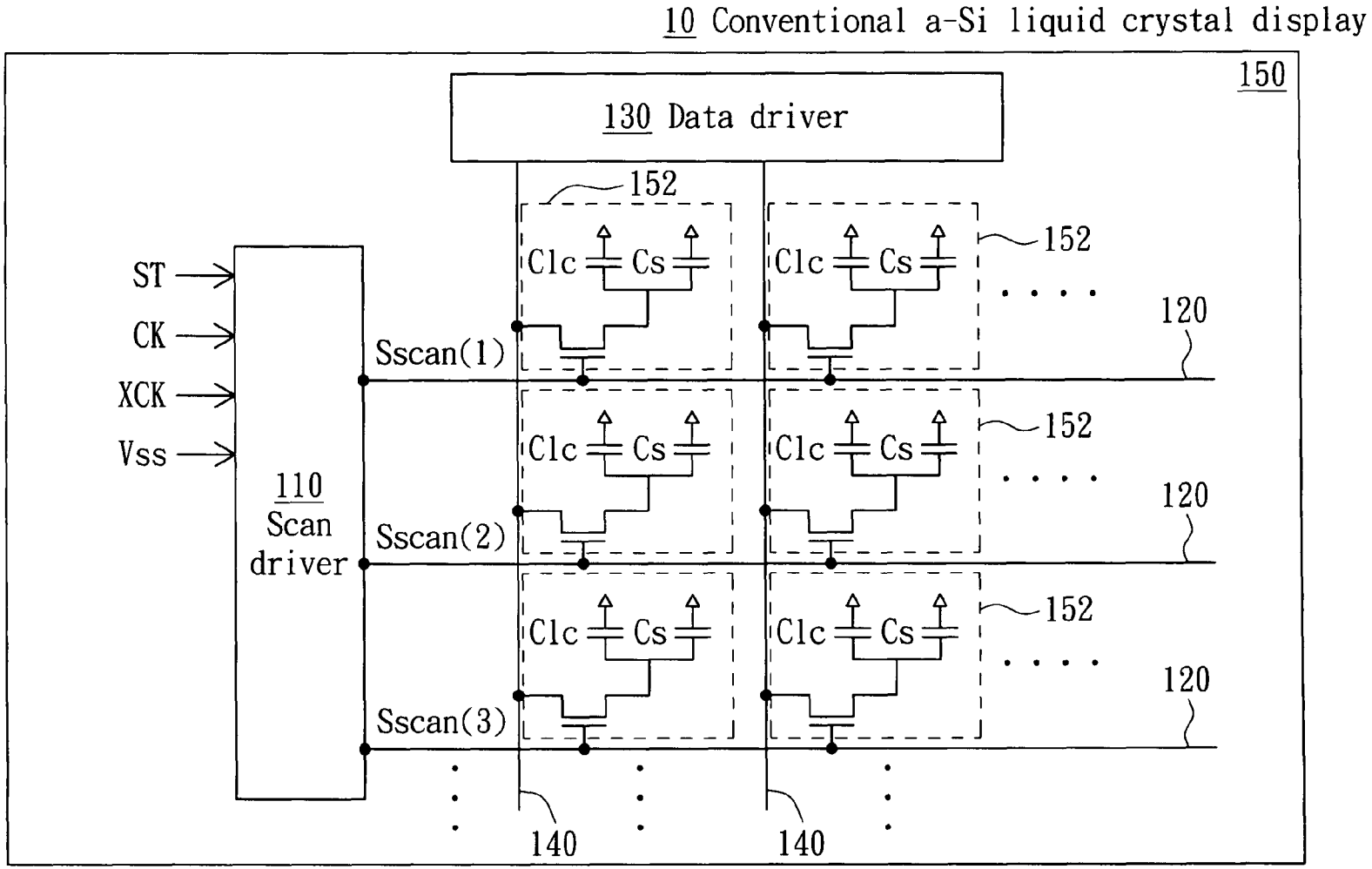
FIG. 1(RELATED ART)
FIG. 1 (Related Art) is a schematic diagram of a conventional a-Si liquid crystal display.
Figure 2:
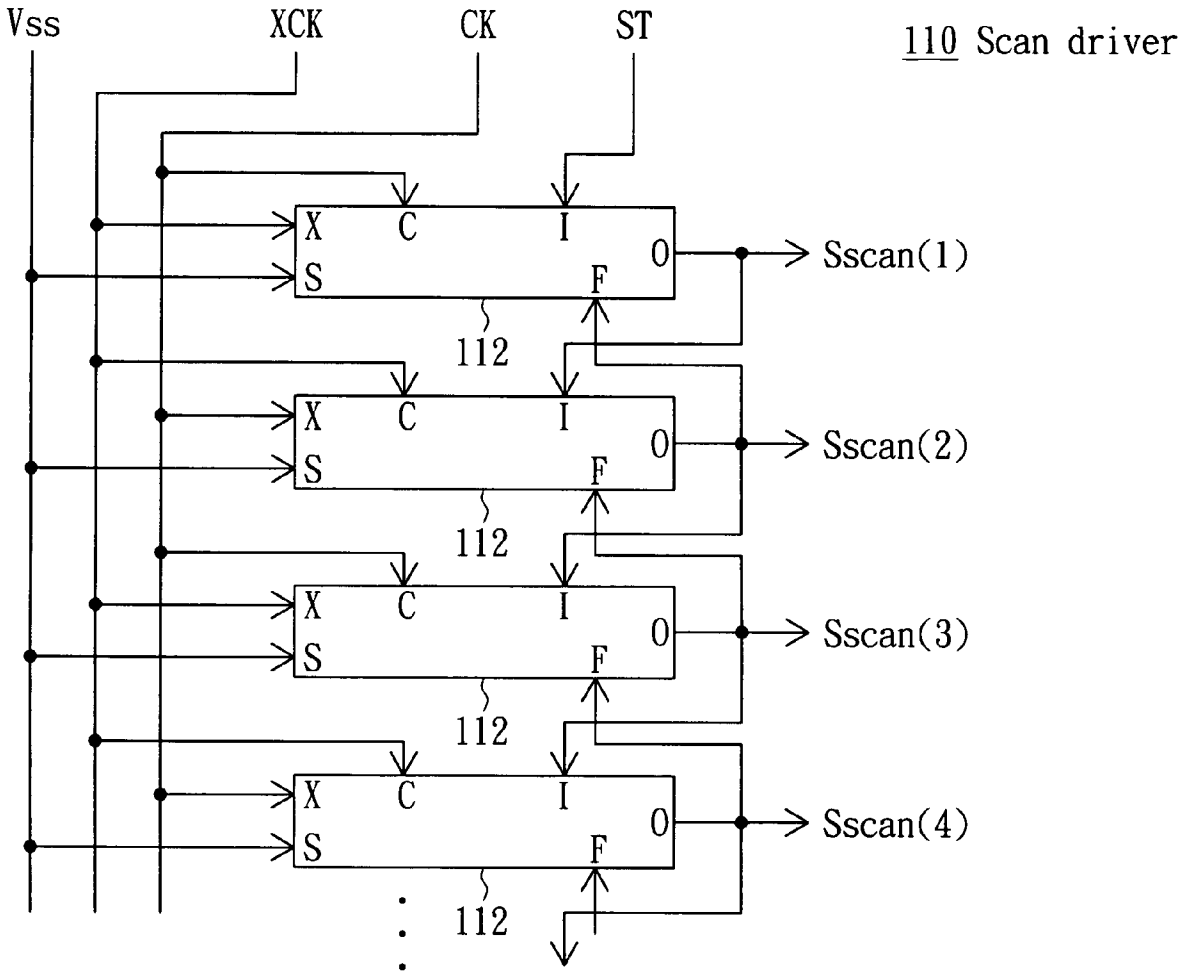
FIG. 2(RELATED ART)
FIG. 2 (Related Art) is a schematic diagram of a scan driver.
Figure 3:
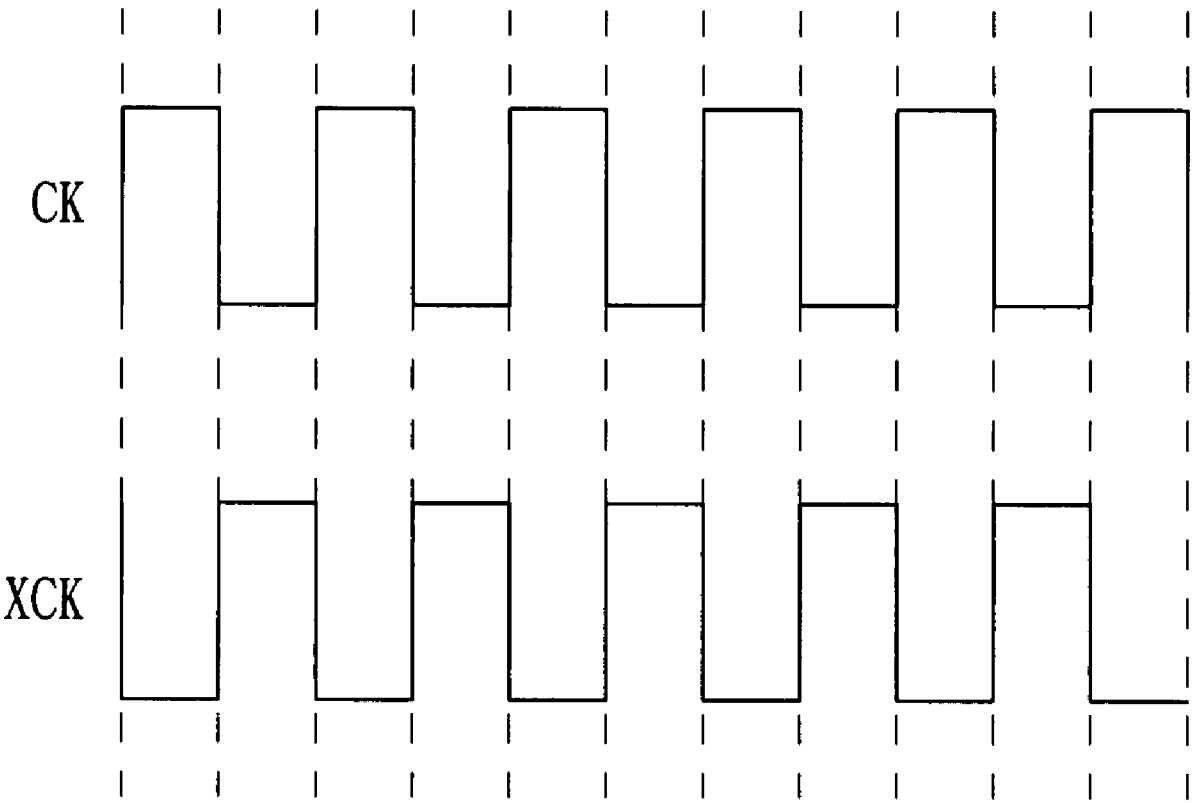
FIG. 3(RELATED ART)
FIG. 3 (Related Art) is a schematic diagram of a clock signal.
Figure 4:
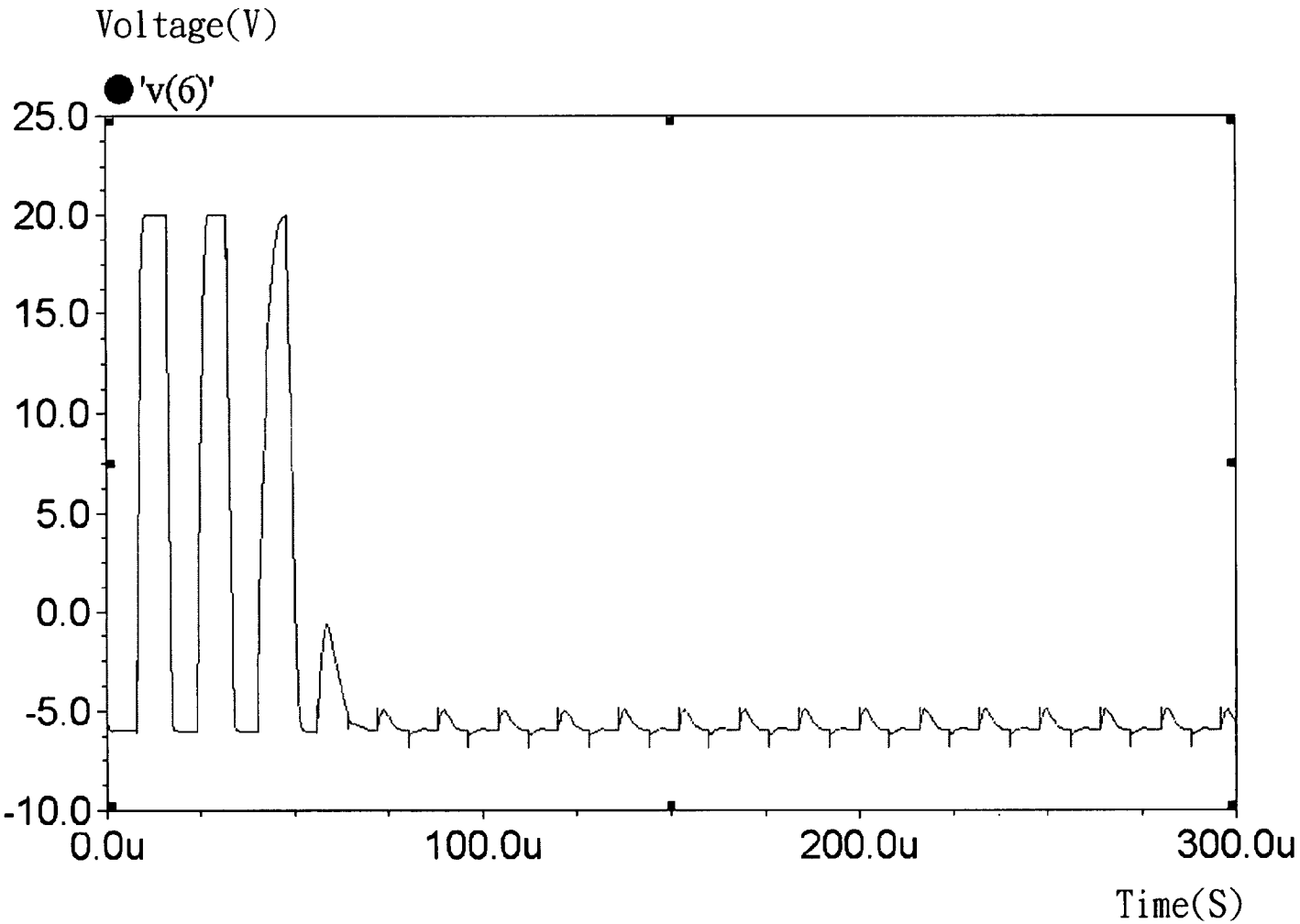
FIG. 4(RELATED ART)
FIG. 4 (Related Art) is a timing diagram of a conventional the scan driving signal.
Figure 5:
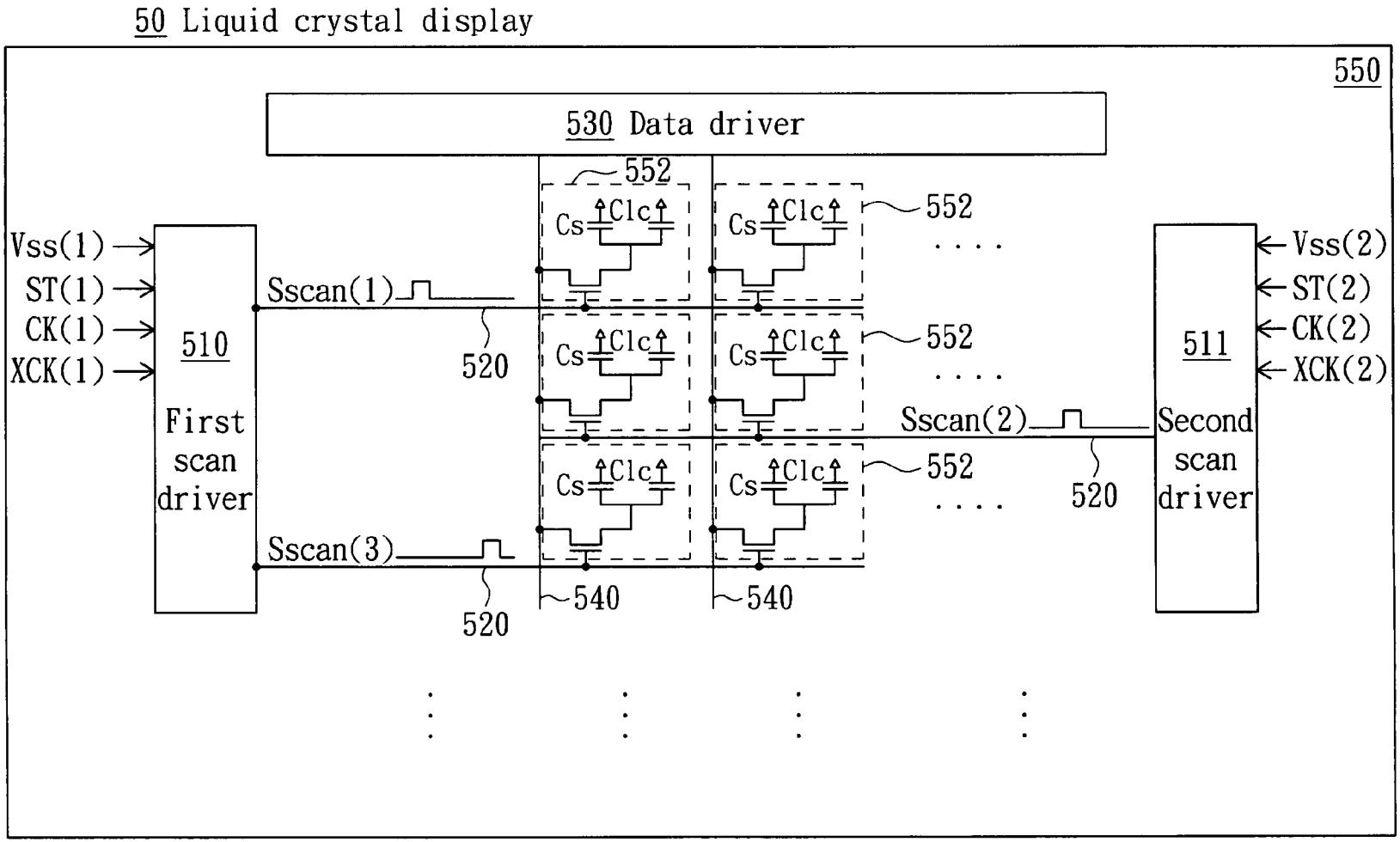
FIG. 5 is a block diagram of a liquid crystal display according to a preferred embodiment of the invention.

Referring to FIG. 5, a block diagram of a liquid crystal display according to a preferred embodiment of the invention is shown. The liquid crystal display 50, such as an a-Si liquid crystal display, includes a first scan driver 510, a second scan driver 511, a scan signal line 520, a data driver 530, a data line 540, and a display panel 550. The display panel 550, such as an a-Si the display panel, includes a pixel 552. The first scan driver 510, the second scan driver 511 and the data driver 530 can be disposed on the display panel 550 with the chip on glass (COG) technology.

The scan signal line 520 is coupled to the pixel 552 for transmitting a scan driving signal $S_{scan}$(n) to a pixel 552, where n is a positive integer. The data line 540 is coupled to the pixel 552 for transmitting an image data to the pixel 552.

The first scan driver 510 is coupled to a power voltage Vss(1). The first scan driver 510 sequentially drives the odd-numbered scan signal line 520 according to a starting signal ST(1), a clock signal CK(1), and a clock signal XCK(1). The second scan driver 511 is coupled to a power voltage Vss(2). The second scan driver 511 sequentially drives the even-numbered scan signal lines 520 according to a starting signal ST(2), a clock signal CK(2), and a clock signal XCK(2).

Figure 6:
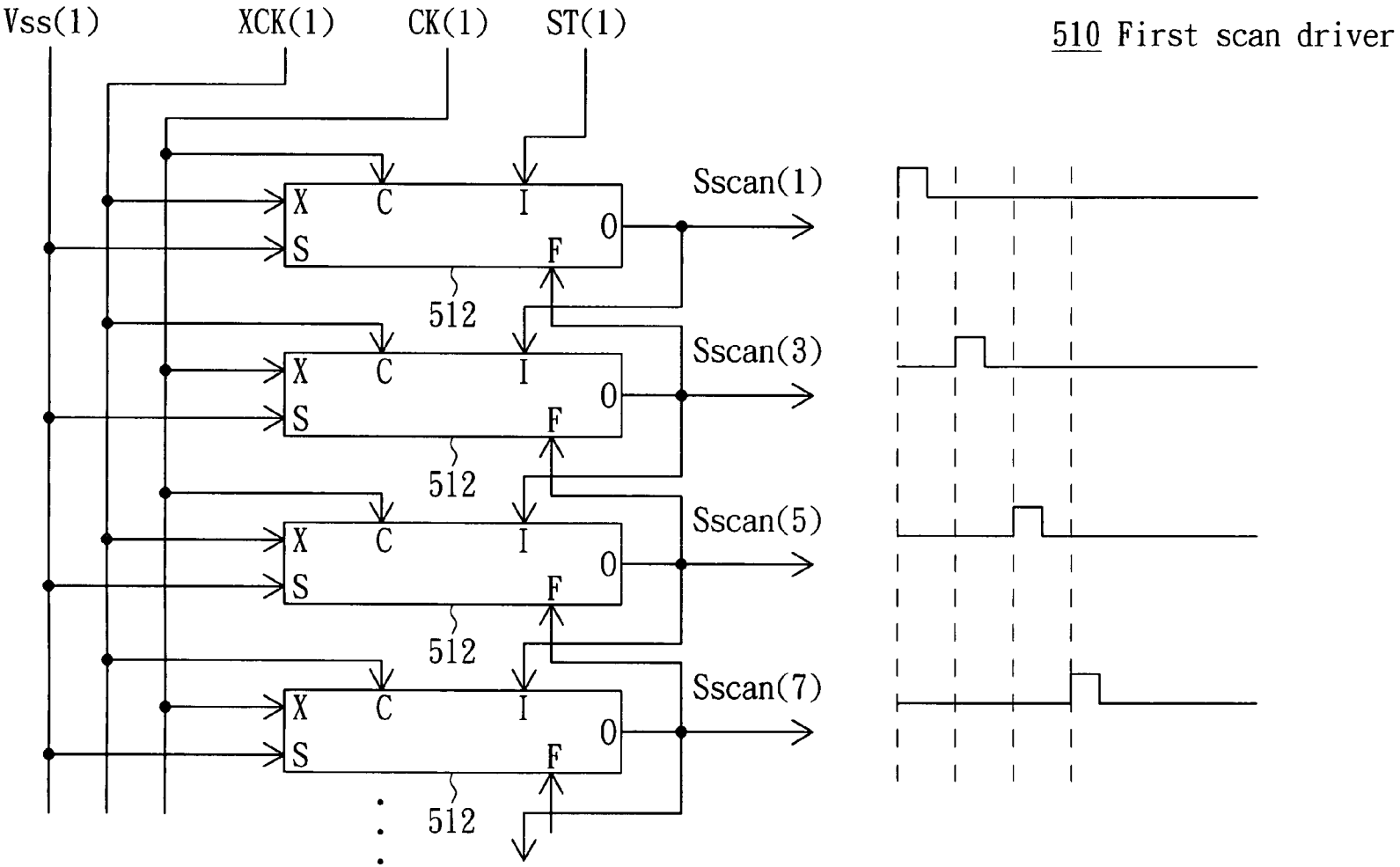
FIG. 6 is a block diagram of the first scan driver 510.

Referring to FIG. 6, a block diagram of the first scan driver 510 is shown. The first scan driver 510 includes level shift register units 512. Each level shift register unit 512 is coupled to a power voltage Vss(1) for receiving a clock signal CK(1) and a clock signal XCK(1).

In the first scan driver 510, after the first level shift register unit 512 receives the starting signal ST(1), the first level shift register unit 512 outputs a scan driving signal $S_{scan}$(1) according to the clock signal CK(1) and the clock signal XCK(1) to drive a first row pixel 552 via a scan signal line 520.

After the second level shift register unit 512 receives the scan driving signal $S_{scan}$(1) outputted by the first level shift register unit 512, the second level shift register unit 512 outputs a scan driving signal $S_{scan}$(3) according to the clock signal CK(1) and the clock signal XCK(1) to drive a third row pixel 552 via the scan signal line 520 The scan driving signal $S_{scan}$(3) is also outputted to the first level shift register unit 512. Likewise, the first scan driver 510 sequentially outputs each of the scan driving signals to drive the pixels 552 of odd-numbered rows.

Figure 7:
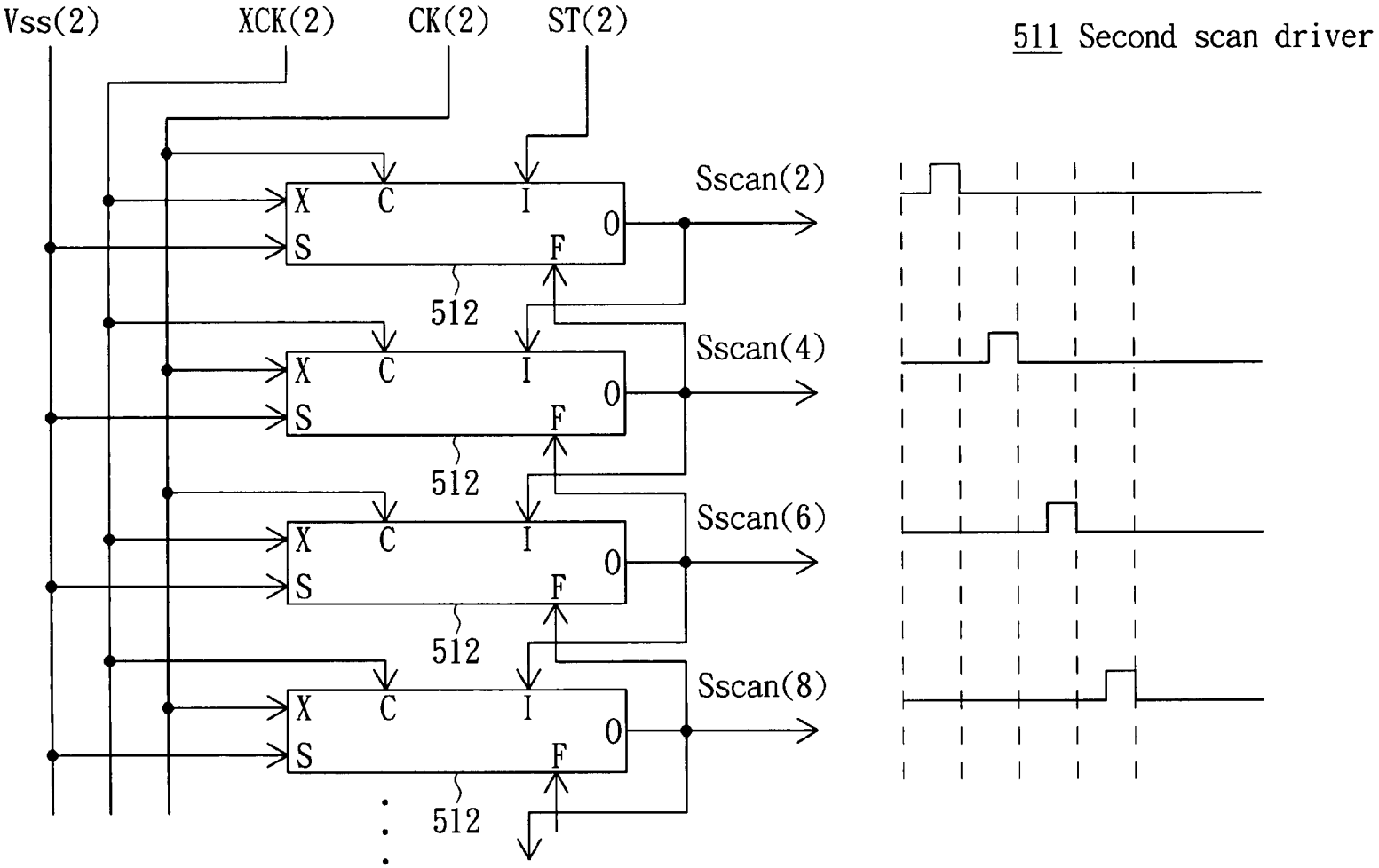
FIG. 7 is a block diagram of the second scan driver 511.

Referring to FIG. 7, a block diagram of the second scan driver 511 is shown. Likewise, the second scan driver 511 includes a shift register unit 512. The shift register unit 512 is coupled to a power voltage Vss(2) for receiving a clock signal CK(2) and a clock signal XCK(2).

In the second scan driver 511, after the first level shift register unit 512 receives a starting signal ST(2), the first level shift register unit 512 outputs a scan driving signal $S_{scan}$(2) according to the clock signal CK(2) and the clock signal XCK(2) to drive a second row pixel 552 via a scan signal line 520.

After the second level shift register unit 512 receives the scan driving signal $S_{scan}$(2) outputted by the first level shift register unit 512, the second level shift register unit 512 outputs a scan driving signal $S_{scan}$(4) according to the clock signal CK(2) and the clock signal XCK(2) to drive a fourth row pixel 552 via the scan signal line 520. The scan driving signal $S_{scan}$(4) is also outputted to the first level shift register unit 512. Likewise, the second scan driver 511 sequentially outputs each of the scan driving signals to drive the pixels 552 of even-numbered rows.

Figure 8:
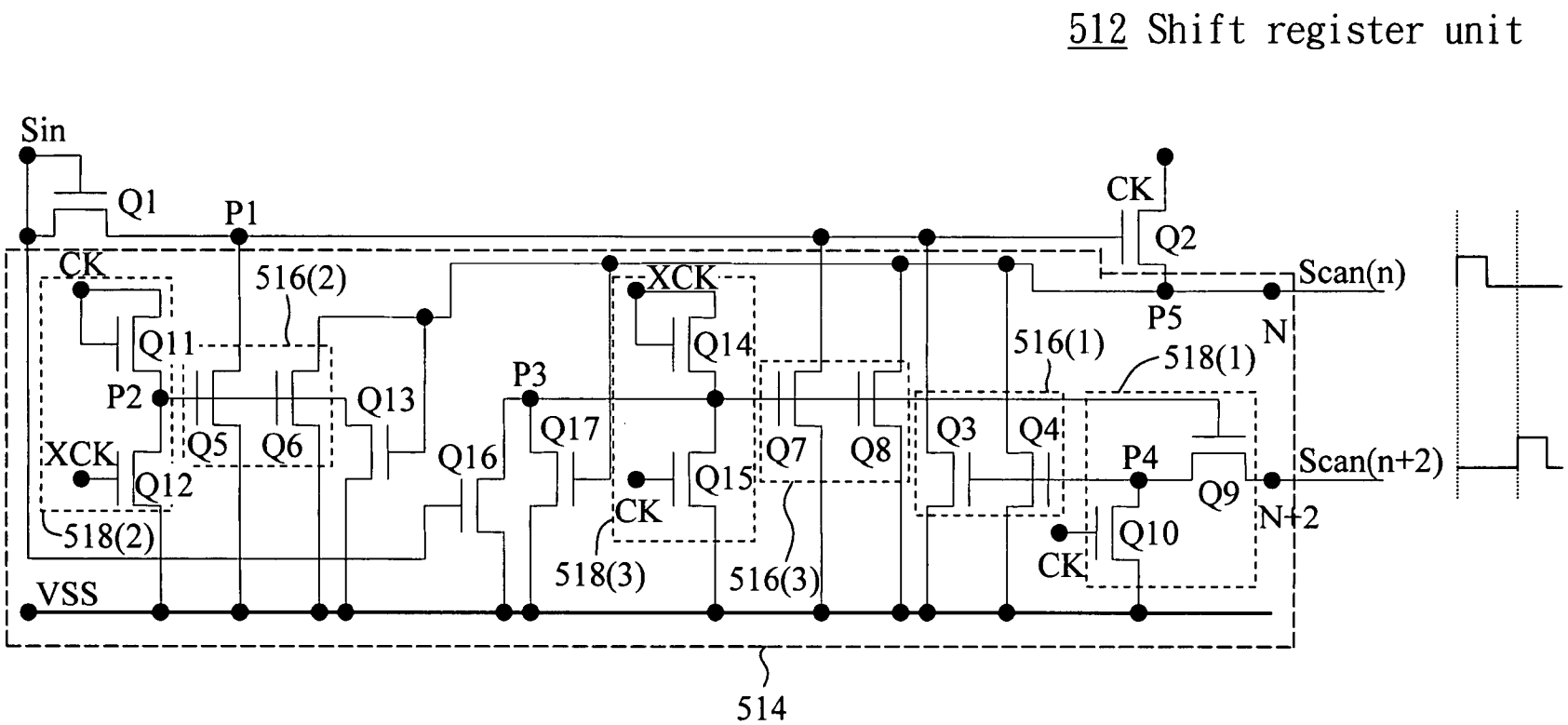
FIG. 8 is a circuit diagram of a shift register unit according to a preferred embodiment of the invention.

Referring to FIG. 8, a circuit diagram of a shift register unit according to a preferred embodiment of the invention is shown. The shift register unit 512 is used for receiving an input signal $S_{in}$, and generating a scan driving signal $S_{scan}$(n) according to the input signal $S_{in}$, where n is a positive integer. Examples of the input signal $S_{in}$ include a starting signal outputted by a timing controller or a scan driving signal outputted by the previous level shift register unit.

The shift register unit 512 includes a switch Q1, a switch Q2, and a level shift circuit 514. The level shift circuit 514 includes level shift modules 516(1)~516(3), control switch units 518(1)~518(3), and switches Q13, Q16, and Q17.

The control switch units 518(1)~518(3) respectively control the level shift modules 516(1)~516(3). The level shift module 516(1) includes switches Q3 and Q4. The level shift module 516(2) includes switches Q5 and Q6. The level shift module 516(3) includes switches Q7 and Q8. The control switch unit 518(1) includes switches Q9 and Q10. The control switch unit 518(2) includes switches Q11 and Q12. The control switch unit 518(3) includes switches Q14 and Q15. Examples of the switches Q1~Q17 are N type thin film transistors with a-Si manufacturing process.

The input terminals of the switches Q1, Q11 and Q14 are respectively coupled to the control terminal of the switches Q1, Q11 and Q14. The output terminals of the switches Q3, Q4, Q5, Q6, Q7, Q8, Q10, Q12, Q13, Q15, Q16, and Q17 are coupled to a power voltage Vss. The input terminals of the switches Q3, Q5 and Q7, the output terminal of the switch Q1, and the control terminal of the switch Q2 are coupled to the node point P1. The input terminal of the switch Q2 receives a clock signal CK. The control terminals of the switches Q5 and Q6, the input terminals of the switches Q12 and Q13, and the output terminal of the switch Q11 are coupled to the node point P2. The control terminals of the switches Q7~Q9, the input terminals of the switches Q15~Q17, and the output terminal of the switch Q14 are coupled to the node point P3. The control terminals of the switches Q3 and Q4, the input terminal of the switch Q10, and the output terminal of the switch Q9 are coupled to the node point P4. The input terminal of the switch Q9 receives an external signal. The external signal is a scan driving signal $S_{scan}$(n+2) outputted by a next level shift register unit 512, where n is a positive integer. The output terminal of the switch Q2, the input terminals of the switches Q4, Q6 and Q8, and the control terminals of the switches Q13 and Q17 are coupled to the node point P5.

The switches Q1 and Q16 are controlled by the input signal $S_{in}$. The switches Q10, Q11 and Q15 are controlled by a clock signal CK, which is the clock signal CK(1) in the first scan driver 510 and is the clock signal CK(2) in the second scan driver 511. The switch Q12 and Q14 is controlled by a clock signal XCK, which is the clock signal XCK(1) in the first scan driver 510 and is the clock signal XCK(2) in the second scan driver 511.

Figure 9:
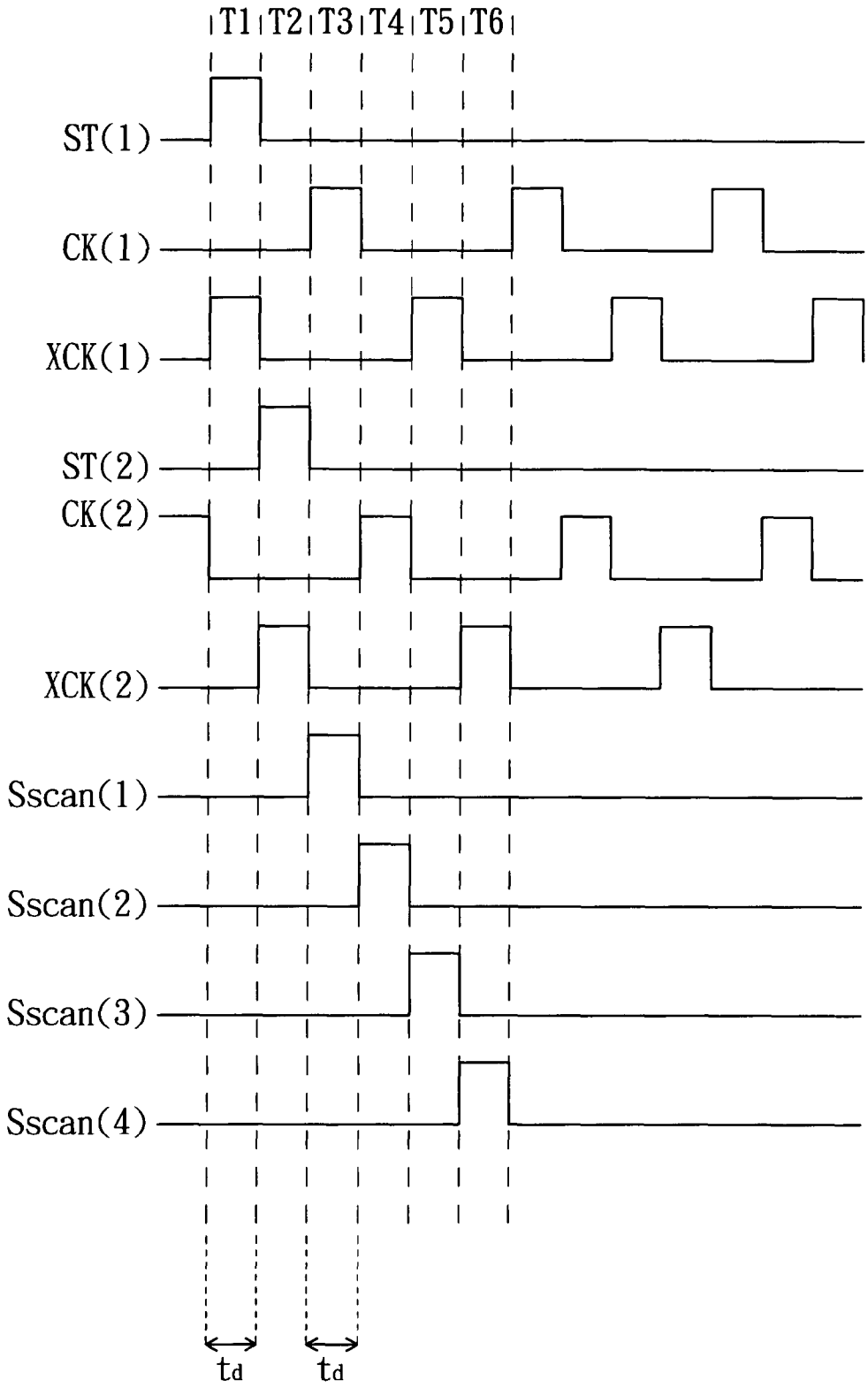
FIG. 9 is a partial timing diagram of a starting signal, a clock signal and a scan driving signal according to a preferred embodiment of the invention.

Referring to FIG. 9, a partial timing diagram of a starting signal, a clock signal and a scan driving signal according to a preferred embodiment of the invention is shown. The starting signal ST(1) of the first scan driver 510 reaches an enabled level during the time period T1. The clock cycle of the clock signal CK(1) is substantially the same with the clock cycle of the clock signal XCK(1). Both the duty cycle of the clock signal CK(1) and the duty cycle of the clock signal XCK(1) are substantially equal to 25%. The phase of the clock signal CK(1) differs with the phase of the clock signal XCK(1) by 180 degrees.

Besides, the starting signal ST(2) of the second scan driver 511 reaches an enabled level during the time period T2. The timing period of the clock signal CK(2) is substantially the same with the timing period of the clock signal XCK(2). Both the duty cycle of the clock signal CK(2) and the timing period of the clock signal XCK(2) are substantially equal to 25%. The phase difference between the clock signal CK(2) and the clock signal XCK(2) is 180 degrees.

The time difference between of the clock signal CK(1) and the clock signal CK(2) is a delay time $t_d$, while the time difference between of the clock signal XCK(1) and the clock signal XCK(2) is a delay time $t_d$.

The first scan driver 510 and the second scan driver 511 both output a scan driving signal $S_{scan}$(n) according to the timing of the starting signal ST(1), the starting signal ST(2), the clock signal CK(1), the clock signal CK(2), the clock signal XCK(1) and the clock signal XCK(2).

If the shift register unit 512 of FIG. 8 is the first level shift register unit 512 of the first scan driver 510, then the input signal $S_{in}$ received by the shift register unit 512 is the starting signal ST(1), the clock signal CK of FIG. 8 is the clock signal CK(1), and the clock signal XCK is the clock signal XCK(1).

During the time period T1, the starting signal ST(1) and the clock signal XCK(1) are at an enabled level and the clock signal CK(1) is at a non-enabled level, such that the switch Q1 is enabled and that the voltage at the node point P1 is charged to a voltage V1 for turning on the switch Q2.

During the time period T3, the clock signal CK(1) is at the enabled level, both the starting signal ST(1) and the clock signal XCK(1) are at the non-enabled level. The voltage at the node point P1 is substantially maintained at the voltage V1. The input terminal of the switch Q2 receives the clock signal CK, which is outputted to the scan signal line 520 via the output terminal of the switch Q2 to form the scan driving signal $S_{scan}$(1).

Likewise, when the next level shift register unit is during the time period T5, the scan driving signal $S_{scan}$(3) is outputted. Given that the scan driving signal $S_{scan}$(3) and the clock signal XCK(1) are both at the enabled level during the time period T5 and that the starting signal ST(1) and the clock signal CK(1) are at the non-enabled level, the switch Q9 of the control switch unit 518(1) is enabled. The scan driving signal $S_{scan}$(3) is outputted to the control terminals of the switches Q3 and Q4 of the level shift module 516(1) via the output terminal of the switch Q9 for enabling the switches Q3 and Q4. Since the switches Q3 and Q4 is enabled, the voltage at the node points P1 and P5 is changed to voltage V2 which is approximately equal to the power voltage Vss for turning off the switch Q2.

After the time period T5, the control switch unit 518(2) and the control switch unit 518(3) alternately enable the level shift module 516(2) and the level shift module 516(3) according to the clock signals CK(1) and XCK(1), such that the voltage at the node points P1 and P5 is maintained at voltage V2 for continually turning off the switch Q2.

Furthermore, when the clock signal CK(1) is at an enabled level and when the voltage at the node point P5 and the clock signal XCK(1) are at the non-enabled level, the Q11 of the control switch unit 518(2) is enabled, the control switch unit 518(2) enables the switches Q5 and Q6 of the level shift module 516(3), such that the voltages at the node points P1 and P5 are maintained at voltage V2 for continually turning off the switch Q2.

When the clock signal XCK(1) is at the enabled level and when the starting signal ST(1) and the clock signal CK(1) are at the non-enabled level, the switch Q14 of the control switch unit 518(3) is enabled, the control switch unit 518(3) enables the switches Q7 and Q8 of the level shift module 516(3) such that the voltage at the node points P1 and P5 is maintained at voltage V2 for continually turning off the switch Q2.

Since the frequencies of the clock signals CK(1), CK(2), XCK(1) and XCK(2) are lower than the clock signal of the conventional scan driver, the operating frequency of the shift register unit 512 is improved. Thus, when the first scan driver 510 or the second scan driver 511 drives a high-resolution liquid crystal display panel, a correct scan driving signal is also outputted to improve the image quality of the liquid crystal display 50.

Figure 10:
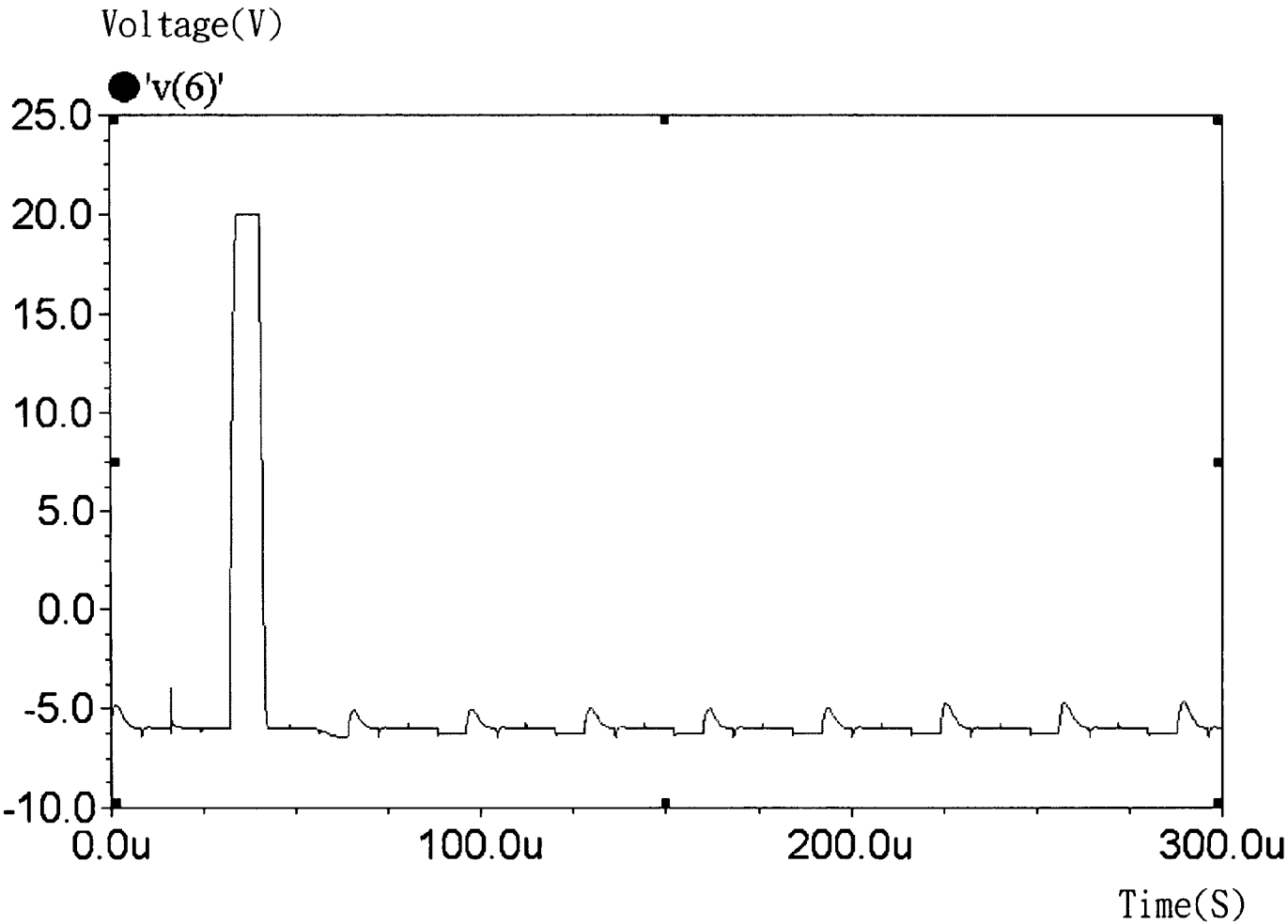
FIG. 10 is a timing diagram of the scan driving signal according to a preferred embodiment of the invention.

Referring to FIG. 10, a timing diagram of the scan driving signal according to a preferred embodiment of the invention is shown. The circuit of the shift register unit 512 disclosed above reduces the frequency of the clock signal CK and the frequency of the clock signal XCK, thereby improving the operating frequency of the scan driver and enabling the first scan driver 510 and the second scan driver 511 to output a correct scan driving signal for driving a high-resolution liquid crystal display panel.

For example, when the starting time of the scan signal line 520 is 5 us, the first scan driver 510 and the second scan driver 511 generate the scan driving signal only during the starting time 5 us to accurately drive the corresponding pixel, hence improving the quality of display frame of the liquid crystal display 50.

According to the liquid crystal display and the shift register unit thereof disclosed in above embodiment of the invention, two groups of scan drivers are used for respectively driving odd-numbered scan signal lines and even-numbered scan signal lines. The first scan driver and the second scan driver respectively receive two independent groups of starting signals and clock signals. The invention has the following advantages:

The first advantage is that the operating frequency is improved. According to the above circuit design, the frequency of the clock signal CK and the frequency of the clock signal XCK are relatively decreased, hence improving the operating frequency of the scan driver.

The second advantage is that the circuit layout design is more flexible. With the first scan driver and the second scan driver being disposed on the two sides of the liquid crystal display panel, there are more positions on which the scan driver can be disposed, such that the circuit layout design is more flexible.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A shift register unit for receiving an input signal and generating a scan driving signal according to the input signal, the shift register unit comprising:

a first switch having a first input terminal, a first control terminal, and a first output terminal;

a second switch having a second input terminal, a second control terminal, and a second output terminal, wherein the second control terminal is coupled to the first output terminal; and a level shift circuit coupled to the second control terminal and the second output terminal, the level shift circuit comprising:

a first level shift module coupled to the second control terminal and the second output terminal;

a second level shift module coupled to the second control terminal and the second output terminal;

a third level shift module coupled to the second control terminal and the second output terminal; and a first control switch unit used for controlling the first level shift module, wherein the first control switch unit is controlled by an external signal, a first clock signal, and a second clock signal, when the external signal and the second clock signal are at an enabled level and when the first clock signal is at a non-enabled level, the first control switch unit enables the first level shift module;

wherein, during a first time period, the first switch is enabled, the first input terminal receives the input signal converting the voltage of the second control terminal into a first voltage for turning on the second switch;

wherein, during a second time period, the second control terminal is substantially maintained at the first voltage, the second input terminal receives the first clock signal, the second output terminal outputs the first clock signal to a scan signal line;

wherein, during a third time period, the first level shift module is enabled for converting the voltage of the second control terminal and the voltage of the second output terminal into a second voltage for turning off the second switch;

wherein, after the third time period, the second level shift module and the third level shift module are alternately enabled to substantially maintain the voltage of the second control terminal and the voltage of the second output terminal at the second voltage.

2. The shift register unit according to claim 1, wherein the level shift circuit further comprises:

a second control switch unit used for controlling the second level shift module, wherein the second control switch unit is controlled by the voltage of the second output terminal, the first clock signal, and the second clock signal, when the first clock signal is at the enabled level and when the voltage of the second output terminal and the second clock signal are at the non-enabled level, the second control switch unit enables the second level shift module; and a third control switch unit used for controlling the third level shift module, wherein the third control switch unit is controlled by the input signal, the first clock signal, and the second clock signal, when the second clock signal is at the enabled level and when the input signal and the first clock signal are at the non-enabled level, the third control switch unit enables the third level shift module.

3. The shift register unit according to claim 2, wherein the first level shift module comprises a third switch, and a fourth switch, the second level shift module comprises a fifth switch, and a sixth switch, the third level shift module comprises a seventh switch and an eighth switch;

wherein, the first control switch unit comprises a ninth switch and a tenth switch, the second control switch unit comprises an eleventh switch and a twelfth switch, the third control switch unit comprises a fourteenth switch and a fifteenth switch;

wherein, the level shift circuit comprises a thirteenth switch, a sixteenth switch, and a seventeenth switch;

wherein, the first input terminal is coupled to the first control terminal, the input terminal of the eleventh switch and the input terminal of the fourteenth switch are respectively coupled to the control terminal of the eleventh switch and the control terminal of the fourteenth switch;

wherein, the output terminals of the third to the eighth switches, the output terminal of the tenth switch, the output terminal of the eleventh switch, the output terminal of the twelfth switch, the output terminal of the thirteenth switch, and the output terminals of the fifteenth to the sixteenth switches are coupled to the power voltage which is approximately equal to the second voltage;

wherein, the output terminal of the third switch, the output terminal of the fifth switch, and the output terminal of the seventh switch are coupled to the first output terminal and the second control terminal;

wherein, the control terminal of the fifth switch, the control terminal of the sixth switch, the input terminal of the twelfth switch, and the input terminal of the thirteenth switch are coupled to the output terminal of the eleventh switch;

the control terminals of the seventh to the ninth switches and the input terminals of the fifteenth to the seventeenth switches are coupled to the output terminal of the fourteenth switch;

the control terminals of the third to the fourth switches and the input terminal of the tenth switch are coupled to the output terminal of the ninth switch, wherein the output terminal of the ninth switch receives the external signal;

the input terminal of the fourth switch, the input terminal of the sixth switch, the input terminal of the eighth switch, the control terminal of the thirteenth switch, and the control terminal of the seventeenth switch are coupled to the second output terminal.

4. The shift register unit according to claim 3, wherein the first switch is controlled by the input signal, while the tenth switch, the eleventh switch, and the fifteenth switch are controlled by the first clock signal, the twelfth switch and the fourteenth switch are controlled by the second clock signal.

5. The shift register unit according to claim 4, wherein the first to the seventeenth switches are N type thin film transistors of a-Si manufacturing process.

6. The shift register unit according to claim 2, wherein, during the first time period, the input signal and the second clock signal are at the enabled level, the first clock signal is at the non-enabled level;

wherein, during the second time period, the first clock signal is at the enabled level, the input signal and the second clock signal are at the non-enabled level;

wherein, during the third time period, the second clock signal is at the enabled level, the input signal and the first clock signal are at the non-enabled level.

7. The shift register unit according to claim 1, wherein the timing period of the first clock signal is substantially the same with the clock cycle of the second clock signal, both the duty cycle of the first clock signal and the duty cycle of the second clock signal are substantially equal to 25%.

8. The shift register unit according to claim 1, wherein the phase difference between the first clock signal and the second clock signal is 180 degrees.

9. A liquid crystal display, comprising:

a plurality of pixels;

a plurality of data lines coupled to the pixels for transmitting an image data to the pixels;

a plurality of odd-numbered scan signal lines and even-numbered scan signal lines, wherein the odd-numbered scan signal lines and the even-numbered scan signal lines are coupled to the pixels for transmitting a scan driving signal to the pixels; and a first scan driver and a second scan driver, wherein the first scan driver is for driving the odd-numbered scan signal lines, the second scan driver is for driving the even-numbered scan signal lines, the first scan driver and the second scan driver respectively comprises a plurality of level shift register units, each level shift register unit comprises: a first switch having a first input terminal, a first control terminal, and a first output terminal;

a second switch having a second input terminal, a second control terminal, and a second output terminal, wherein the second control terminal is coupled to the first output terminal; and a level shift circuit coupled to the second control terminal and the second output terminal, the level shift circuit comprising:

a first level shift module coupled to the second control terminal and the second output terminal;

a second level shift module coupled to the second control terminal and the second output terminal;

a third level shift module coupled to the second control terminal and the second output terminal; and a first control switch unit used for controlling the first level shift module, wherein the first control switch unit is controlled by an external signal, a first clock signal, and a second clock signal, when the external signal and the second clock signal are at an enabled level and when the first clock signal is at a non-enabled level, the first control switch unit enables the first level shift module;

wherein, during a first time period, the first switch is enabled, the first input terminal receives an input signal converting the voltage of the second control terminal into a first voltage for turning on the second switch;

wherein, during a second time period, the second control terminal is substantially maintained at the first voltage, the second input terminal receives the first clock signal, the second output terminal outputs the first clock signal to one of the odd-numbered scan signal lines or one of the even-numbered scan signal lines to form the scan driving signal;

wherein, during a third time period, the first level shift module is enabled for converting the voltage of the second control terminal and the voltage of the second output terminal into a second voltage for turning off the second switch;

wherein, after the third time period, the second level shift module and the third level shift module are alternately enabled to substantially maintain the voltage of the second control terminal and the voltage of the second output terminal at the second voltage.

10. The liquid crystal display according to claim 9, wherein the level shift circuit further comprises:

a second control switch unit used for controlling the second level shift module, wherein the second control switch unit is controlled by the voltage of the second output terminal, the first clock signal, and the second clock signal, when the first clock signal is at the enabled level and when the voltage of the second output terminal and the second clock signal are at the non-enabled level, the second control switch unit enables the second level shift module; and a third control switch unit used for controlling the third level shift module, wherein the third control switch unit is controlled by the input signal, the first clock signal and the second clock signal, when the second clock signal is at the enabled level and when the input signal and the first clock signal are at the non-enabled level, the third control switch unit enables the third level shift module;

wherein, the external signal is a scan driving signal of the next level shift register unit.

11. The liquid crystal display according to claim 10, wherein the first level shift module comprises a third switch and a fourth switch, the second level shift module comprises a fifth switch and a sixth switch, the third level shift module comprises a seventh switch and an eighth switch;

wherein, the first control switch unit comprises a ninth switch and a tenth switch, the second control switch unit comprises an eleventh switch and a twelfth switch, the third control switch unit comprises a fourteenth switch and a fifteenth switch;

wherein, the level shift circuit comprises a thirteenth switch, a sixteenth switch, and a seventeenth switch;

wherein, the first input terminal is coupled to the first control terminal, the input terminal of the eleventh switch and the input terminal of the fourteenth switch are respectively coupled to the control terminal of the eleventh switch and the control terminal of the fourteenth switch;

wherein, the output terminals of the third to the eighth switches, the output terminal of the tenth switch, the output terminal of the eleventh switch, the output terminal of the twelfth switch, the output terminal of the thirteenth switch, and the output terminal of the fifteenth to the sixteenth switch are coupled to a power voltage which is approximately equal to the second voltage;

wherein, the output terminal of the third switch, the output terminal of the fifth switch, and the output terminal of the seventh switch are coupled to the first output terminal and the second control terminal;

wherein, the control terminals of the fifth to the sixth switches, the input terminal of the twelfth switch, and the input terminal of the thirteenth switch are coupled to the output terminal of the eleventh switch;

the control terminal of the seventh to the ninth switches and the input terminal of the fifteenth to the seventeenth switches are coupled to the output terminal of the fourteenth switch;

the control terminal of the third to the fourth switches and the input terminal of the tenth switch are coupled to the output terminal of the ninth switch, the output terminal of the ninth switch receives the external signal;

the input terminal of the fourth switch, the input terminal of the sixth switch and the input terminal of the eighth switch, the control terminal of the thirteenth switch, and the control terminal of the seventeenth switch are coupled to the second output terminal.

12. The liquid crystal display according to claim 11, wherein the first switch is controlled by the input signal, while the tenth switch, the eleventh switch and the fifteenth switch are controlled by the first clock signal, the twelfth switch and the fourteenth switch are controlled by the second clock signal.

13. The liquid crystal display according to claim 12, wherein the first to the seventeenth switches are N type thin film transistors of a-Si manufacturing process.

14. The liquid crystal display according to claim 10, wherein, during the first time period, the input signal and the second clock signal are at the enabled level, the first clock signal is at the non-enabled level;

wherein, during the second time period, the first clock signal is at the enabled level, the input signal and the second clock signal are at the non-enabled level;

wherein, during the third time period, the second clock signal is at the enabled level, the input signal and the first clock signal are at the non-enabled level.

15. The liquid crystal display according to claim 9, wherein the timing period of the first clock signal is substantially the same with the clock cycle of the second clock signal, both the duty cycle of the first clock signal and the duty cycle of the second clock signal are substantially equal to 25%.

16. The liquid crystal display according to claim 9, wherein the phase difference between the first clock signal and the second clock signal is 180 degrees.

* * * * *